US006540322B2

(12) United States Patent
Usui et al.

(10) Patent No.: US 6,540,322 B2
(45) Date of Patent: Apr. 1, 2003

(54) INK JET RECORDING APPARATUS AND INK SUCTION METHOD OF THE RECORDING HEAD

(75) Inventors: Minoru Usui, Nagano (JP); Kenji Tsukada, Nagano (JP); Takahiro Katakura, Nagano (JP); Tomoaki Takahashi, Nagano (JP); Kazuhiko Hara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/950,714

(22) Filed: Sep. 13, 2001

(65) Prior Publication Data

US 2002/0008728 A1 Jan. 24, 2002

Related U.S. Application Data

(62) Division of application No. 09/047,333, filed on Mar. 25, 1998, now Pat. No. 6,312,092.

(30) Foreign Application Priority Data

| | | |
|---|---|---|
| Mar. 25, 1997 | (JP) | 9-72221 |
| Mar. 26, 1997 | (JP) | 9-91560 |
| Apr. 30, 1997 | (JP) | 9-126418 |
| Jan. 22, 1998 | (JP) | 10-10610 |

(51) Int. Cl.[7] ..... B41J 2/165
(52) U.S. Cl. ..... 347/29
(58) Field of Search ..... 347/29, 30

(56) References Cited

U.S. PATENT DOCUMENTS

| | | | | |
|---|---|---|---|---|
| 5,483,266 A | | 1/1996 | Nakamura | 347/23 |
| 5,670,996 A | * | 9/1997 | Mitani | 347/29 |
| 5,670,997 A | | 10/1997 | Sugimoto et al. | 347/30 |
| 5,784,081 A | | 7/1998 | Ozaki et al. | 347/30 |

FOREIGN PATENT DOCUMENTS

| | | |
|---|---|---|
| EP | 0 423 475 A1 | 4/1991 |
| EP | 0 576 033 A2 | 12/1993 |
| EP | 0 580 437 A2 | 1/1994 |
| JP | 7-68766 | 3/1995 |
| JP | 7-195712 | 8/1995 |

OTHER PUBLICATIONS

Patent Abstracts of Japan JP 02155654 A (Canon Inc.), Jun. 14, 1990 Abstract.
Patent Abstracts of Japan JP 07 290723 A (Seiko Epson Corp.) Nov. 7, 1995 Abstract.
Patent Abstracts of Japan JP 02 266949 A (Canon Inc.) Oct. 31, 1990 Abstract.
Patent Abstracts of Japan JP 62 113559 (Canon Inc.) May 25, 1987.
Patent Abstracts of Japan JP 08 267787 A (Citizen Watch Co. Ltd), Oct. 15, 1996.
Patent Abstracts of Japan JP 07 214795 A (Canon Inc), Aug. 15, 1995.
Patent Abstracts of Japan JP 06 344569 A (Brother Ind Ltd), Dec. 20, 1994.
Patent Abstracts of Japan JP 02 055147 A (Fujitsu Ltd), Feb. 23, 1990.

* cited by examiner

*Primary Examiner*—Judy Nguyen
(74) *Attorney, Agent, or Firm*—Sughrue Mion, PLLC

(57) ABSTRACT

An ink jet recording apparatus in which a nozzle ink jet recording head provided with a nozzle plate provided with apertures for jetting an ink droplet and a capping device provided with a cap unit for sealing the apertures of the nozzle plate when the recording apparatus is not used are mounted, in which in the cap unit of the capping device, in a sealed state, an ink suction port for supplying negative pressure for exhausting ink from a nozzle aperture if necessary is arranged at the bottom and an atmospheric air open port for releasing negative pressure is arranged on one side and in which a porous plate provided with plural through holes for adjusting the distribution of pressure in the longitudinal direction of the cap unit is housed between the inner bottom face and the upper open face of the cap unit and further, an ink suction method of a recording head are provided.

30 Claims, 13 Drawing Sheets

INK JET RECORDING APPARATUS AND INK SUCTION METHOD OF THE RECORDING HEAD

This is a Divisional of application Ser. No. 09/047,333 filed Mar. 25, 1998, now U.S. Pat. No. 6,312,092, the disclosure of which is incorporated herein by reference.

BACKGROUND OF THE INVENTION

1. Field of the Invention

The present invention relates to an ink jet recording apparatus and an ink suction method of the recording head.

Specifically, the present invention relates to an ink jet recording apparatus provided with a recording head which is moved in the direction of the width of a recording paper for printing an image on the recording paper by jetting an ink droplet toward the recording paper based upon print data and more, particularly relates to an ink jet recording apparatus wherein ink is prevented from being dry and being clogged by forming the capping device so that the capping device has a specific structure, the printing of a dot is never omitted and color mixture and mottled color are prevented in color printing, and an ink suction method of the recording head in flushing and cleaning.

2. Description of the Related Art

As graphic processing can be relatively easily executed owing to the development of a personal computer, a recording apparatus which enables the output of a high quality hard copy of a color image on a display is desired.

A recording apparatus in which an ink jet recording head is mounted to meet such a request is provided.

As in such an ink jet recording apparatus, noise in printing is relatively small and a small dot can be formed in high density, it is used for multiple types of printing including color printing.

Such an ink jet recording apparatus is provided with an ink jet recording head to which ink is supplied from ink storage means and paper feed means for relatively moving recording paper to the recording head so as to record by jetting an ink droplet on recording paper, moving the recording head according to a printing signal and forming dots.

A recording head which enables the jetting of black, yellow, cyan and magenta ink is provided to a common head holder and enables not only the printing of a text by black ink but full color printing by changing the ratio in which each ink is jetted. As such an ink jet recording head prints by jetting ink pressurized in a pressure generating chamber on recording paper from a nozzle as an ink droplet, there is a problem that a nozzle aperture is clogged due to the increase of the viscosity of ink and the solidification of ink respectively caused by the evaporation of a solvent from a nozzle aperture, the adhesion of dust, further, the mixture of a bubble and others and as a result, the failure of printing occurs.

Therefore, an ink jet recording apparatus is normally provided with a capping device for sealing a nozzle aperture of the recording head while the ink jet recording apparatus is not used and cleaning means for cleaning a nozzle plate if necessary.

The capping device not only functions as a cap for preventing ink from being dry at a nozzle aperture but is provided with a function for sealing a nozzle plate by a cap member, sucking ink from a nozzle aperture by negative pressure from a suction pump and solving the clogging of the nozzle aperture if the nozzle aperture is clogged.

Processing for compulsorily exhausting ink executed to solve the clogging of a recording head is normally called cleaning, is executed in case printing is restarted after longtime cessation and in case a user presses a cleaning switch to solve the clogging of a recording head and is processing for wiping by a cleaning member formed of an elastic plate such as rubber after an ink droplet is jetted.

A function for applying a driving signal not related to printing to a recording head so as to jet an ink droplet is also provided, is normally called flushing and is operation executed every fixed cycle to recover an uneven meniscus in the vicinity of a nozzle aperture of a head by wiping and others in cleaning and to prevent a nozzle aperture which hardly jets an ink droplet in printing from being clogged.

FIG. 12 is a sectional view showing the schematic constitution of a capping device used for a conventional type ink jet recording apparatus and shows a state in which ink is sucked from a recording head by a cap unit constituting the capping device. FIG. 13 shows a state of the cap unit when it is viewed from the top.

A cap unit 38 is constituted by a rectangular cap case 40 the top face of which is open and a cap member 16 housed in the cap case 40 and formed of flexible material and the cap member 16 is formed with the upper edge slightly protruded from the cap case 40.

An ink absorber 17 formed by porous material is housed at the inner bottom of the cap member 16.

An ink suction port 18 and an atmospheric air open port 19 in most apparatuses are arranged through the cap case 40 and the cap member 16 at the bottom of the cap case 40 and the cap member 16.

The above ink suction port 18 and the atmospheric air open port 19 are arranged so that they are located at a predetermined interval approximately along the center in the longitudinal direction of the capping device when the capping device is viewed from the top as shown in FIG. 13.

In the meantime, a reference number 8 denotes a recording head for color, the recording head 8 is located over the capping device and a nozzle plate 14 is capped by the capping device.

A nozzle aperture 15 is arranged in the nozzle plate 14 and is constituted so that yellow, cyan and magenta ink is jetted by the action of a piezoelectric vibrator 13 arranged corresponding to each nozzle aperture 15.

In the above constitution, ink suction action for solving the clogging of a nozzle aperture is executed by operating a suction pump connected to the ink suction port 18 of the cap member with the cap member 16 closely touched to the nozzle plate 14 of the recording head 8 as shown in FIG. 12 and applying negative pressure to the inside of the cap.

Ink is jetted from the nozzle aperture 15, the atmospheric air flows in from the atmospheric air open port 19 when negative pressure inside the cap is reduced to some extent and negative pressure inside the cap is all released.

However, in the conventional type constitution shown in FIGS. 12 and 13, as the atmospheric air open port 19 is provided under the cap, ink is left at the end of the atmospheric air open port 19 after ink is sucked.

Further, as a sheet formed of porous material is normally used for the ink absorber 17 provided inside the cap, ink bubbles are blown up because opening to the atmospheric air is executed through such an ink absorber.

When such ink bubbles are scattered and adhere to the nozzle aperture 15, color mixture and the failure of printing in a dot occur.

To solve such problems, technique disclosed in Japanese Patent Publication No. Hei. 7-68766 for example for elastically deforming a cap by minutely moving a carriage on which a recording head is mounted or pulling the cap and executing opening to the atmospheric air from clearance made between a nozzle plate and the cap or technique for providing an atmospheric air open port on the surface of the nozzle plate of a recording head and executing opening to the atmospheric air from the side of the head is proposed.

However, as for the former technique, fatigue, distortion and others may occur in cap material due to long-term reciprocation, adhesion between a cap and a nozzle plate may be lost and the reliability of an apparatus is deteriorated.

Also, as for the latter technique, as a head is large-sized by providing an atmospheric air open port on the surface of a nozzle plate and a cap itself is further large-sized, there occurs a problem that the efficiency of suction is deteriorated.

As in a recent ink jet recording apparatus, the number of nozzle apertures constituting a recording head is increased to meet a request for high speed printing and high quality of color printing and as a result, the recording head has a tendency to be large-sized.

Therefore, a cap unit of a capping device for sealing the recording head is also necessarily large-sized, large unbalance occurs in negative pressure to act because of the increase of distance between the ink suction port 18 communicating with a suction pump and the nozzle aperture 15 and ink is difficult to uniformly jet from all nozzle apertures constituting the recording head.

To partly solve such problems, a flow regulating plate for positively changing the resistance of a passage for leading exhausted ink corresponding to distance from an ink suction port is inserted as disclosed in Japanese Patent Publication No. Hei. 7-195712 for example and to promptly and securely exhaust ink into a cap member outside without scattering ink, a capping device provided with an atmospheric air communicating hole disclosed in Japanese Patent Publication No. Hei. 7-290723 and others are proposed, however, as these are provided to securely exhaust ink into a large-sized capping device outside and negative pressure to act on a nozzle aperture cannot be adjusted, ink cannot be uniformly jetted from any nozzle aperture and there is still left a problem that the mottled color and color mixture of printing caused by the above uneven jetting cannot be completely avoided.

SUMMARY OF THE INVENTION

The present invention is made to solve the above problems and a first object is to provide an ink jet recording apparatus in which a small-sized capping device which enables preventing color mixture and the failure of printing in a dot without scattering ink to the side of a nozzle plate when the inside of a cap is opened to the atmospheric air after ink is sucked is mounted.

The provision of an ink jet recording apparatus which simplifies the constitution of a valve for making an atmospheric air open port communicate with the atmospheric air and enables reducing the cost of the apparatus is added to the above object.

Further, a second object is to provide an ink jet recording apparatus which can uniformly apply negative pressure to a nozzle aperture when negative pressure is applied to a recording head and ink is compulsorily exhausted from a nozzle aperture of the recording head and in which the mottled color and color mixture of printing caused by the unbalance of negative pressure are completed avoided.

Further another object of the present invention is to provide an ink suction method from a recording head of a recording apparatus which is effective to prevent ink from bubbling in a capping device when ink is sucked and to prevent ink from adhering to a nozzle aperture.

According to the present invention, as an ink jet recording apparatus equivalent to a first embodiment to achieve the above objects, an ink jet recording apparatus in which a nozzle ink jet recording head provided with a nozzle plate provided with an aperture for jetting an ink droplet and a capping device provided with a cap unit for sealing the apertures of the nozzle plate when the recording apparatus is not used are mounted and which is characterized in that an ink suction port for supplying negative pressure for exhausting ink from a nozzle aperture if necessary is arranged at the bottom of the cap unit of the capping device while the apertures of the nozzle plate are sealed and an atmospheric air open port for releasing the negative pressure is arranged on its one side is provided.

Also, according to the present invention, as an ink jet recording apparatus equivalent to a second embodiment, an ink jet recording apparatus in which a nozzle ink jet recording head provided with a nozzle plate provided with an aperture for jetting an ink droplet and a capping device provided with a rectangular cap unit for sealing the apertures of the nozzle plate when the recording apparatus is not used are mounted and which is characterized in that an ink suction port for supplying negative pressure for exhausting ink from a nozzle aperture is arranged at the bottom of the cap unit of the capping device and a porous plate provided with plural through holes for adjusting the distribution of pressure in the longitudinal direction of the cap unit is housed between the inner bottom face of the cap unit and the upper open face is provided.

Further, according to the present invention, as an ink suction method of a recording head in an ink jet recording apparatus provided with an ink jet recording head for jetting an ink droplet corresponding to print data, capping means which selectively communicates with the atmospheric air and to which negative pressure from a suction pump is applied for sealing the recording head and gas suction means for supplying negative pressure to the capping means, an ink suction method of an ink jet recording head comprising a process for exhausting slight quantity of ink from the recording head and injecting the ink into the capping means, a process for sealing the recording head by the capping means and a process for applying negative pressure from the suction pump to the capping means and sucking ink from the recording head is provided.

The ink jet recording apparatus equivalent to the first embodiment of the present invention made to achieve the above object is an ink jet recording apparatus in which an ink jet recording head for jetting an ink droplet and a capping device provided with a capping unit for sealing nozzle apertures when the recording apparatus is not used and sucking ink from a nozzle aperture if necessary are mounted and is characterized remarkably in the constitution in that an atmospheric air open port for opening the inside of the cap unit to the atmospheric air is arranged on one side of the cap unit of the capping device.

In this case, it is desirable that an ink absorber is housed in the cap unit and the atmospheric air open port arranged on one side of the cap is located above the ink absorber.

It is desirable that the atmospheric air open port is formed so that the atmospheric air open port is tilted toward the ink absorber.

In a desirable embodiment, an ink suction port is arranged at the bottom on the other side opposite to one side on which the atmospheric air open port of the cap unit is arranged.

The cap unit is formed in a rectangle, the atmospheric air open port is arranged at a corner on one side of the cap unit and the ink suction port may be arranged at the bottom at a corner opposite to the atmospheric air open port diagonally.

Further, the capping device is constituted at least by a cap case and a cap member formed of flexible material, the cap member is formed so that it is protruded from the upper edge of the cap case, an atmospheric air open port pierced in the direction of the thickness of the cap member is provided to a part of the cap member protruded from the cap case and the atmospheric air open port is constituted so that it is closed or opened according to pressure of the cap member upon the recording head.

In this case, it is desirable that the upper edge of the cap member to which the atmospheric air open port is provided is protruded from the other part.

In an ink jet recording apparatus provided with the capping device constituted as described above, as the atmospheric air open port for opening the inside of the cap to the atmospheric air is arranged on one side of the cap, ink bubbles can be prevented from being generated in opening to the atmosphere and ink left at the end of the atmospheric air open port can be effectively prevented from being scattered on the side of a nozzle plate.

The flow of air is formed in opening to the atmospheric air and the flow of ink can be improved by arranging the ink suction port at the bottom on the other side opposite to one side on which the atmospheric air open port is arranged or arranging the ink suction port at the bottom at a corner opposite to the atmospheric air open port diagonally.

Further, the atmospheric air open port is closed or opened according to the pressure of the cap member upon the recording head by forming the atmospheric air open port so that it is pierced in the direction of the thickness of the cap member.

The ink jet recording apparatus equivalent to the second embodiment of the present invention is characterized remarkably in the constitution in that a porous plate provided with plural through holes for adjusting the distribution of pressure in the longitudinal direction of the cap is housed between the inner bottom face of the cap of the cap unit provided with the negative pressure supplying ink suction port in the capping device and the open face so as to adjust negative pressure applied to a nozzle aperture.

Hereby, as negative pressure from the ink suction port can be adjusted so that it uniformly acts upon any nozzle aperture independent of the length of the recording head and ink can be uniformly exhausted from any nozzle aperture, fine and visible printing and images without mottled color and color mixture can be stably provided even if multiple ink colors are provided and the recording head and the cap unit of the capping device for sealing the recording head are large-sized.

Further, a thin hole of an ink absorbing sheet housed in the capping means is sealed with ink beforehand, the capacity of space in the capping means is reduced and the inclusion of air can be reduced and bubbles can be prevented from being generated in sucking ink by using an ink suction method according to the present invention comprising a process for exhausting slight quantity of ink from the recording head and injecting ink into the capping means, a process for sealing the recording head by the capping means and a process for applying negative pressure from the suction pump to the capping means and sucking ink from the recording head.

BRIEF DESCRIPTION OF THE DRAWINGS

In the accompanying drawings:

FIG. 14A is a plan view, FIG. 14B is a sectional view viewed along a line A—A in FIG. 14A, FIG. 14C is a sectional view viewed along a line B—B in FIG. 14A and FIG. 14D is a sectional view viewed along a line C—C in FIG. 14A;

DETAILED DESCRIPTION OF THE PREFERRED EMBODIMENTS

Figure 1:
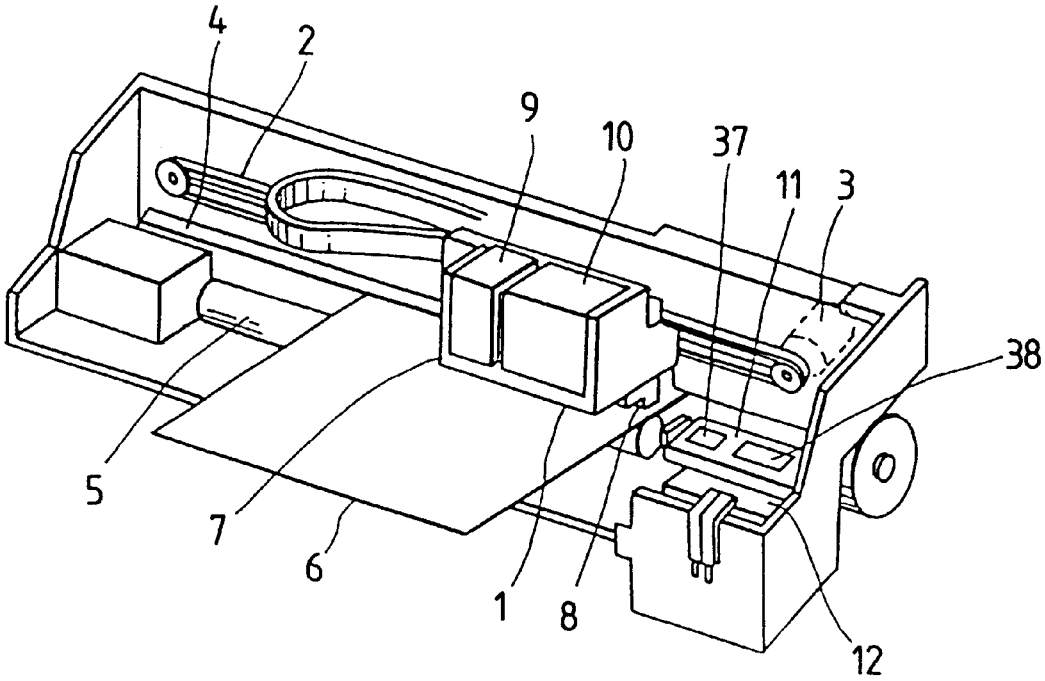
FIG. 1 is a perspective drawing showing an ink jet recording apparatus to which the present invention is applied.

First and second embodiments shown in the drawings of an ink jet recording apparatus according to the present invention and ink suction methods of the respective recording heads will be described in order below.

FIG. 1 shows an embodiment of an ink jet recording apparatus according to the present invention, a reference number 1 denotes a carriage and the carriage is constituted so that the carriage is guided by a guide member 4 via a timing belt 2 reciprocated by driving a carriage motor 3 and reciprocated in the axial direction of a platen 5.

A recording head for black 7 and a recording head for color 8 are mounted on the side opposite to recording paper 6 of the carriage 1, and an ink cartridge for black 9 and an ink cartridge for color 10 for supplying ink to the respective recording heads are respectively installed over the recording heads so that the ink cartridges can be detached.

A reference number 11 denotes a capping device arranged outside a printing area, and a cap unit 37 for the head for black 7 and a cap unit 38 for the head for color 8 are mounted in the capping device.

A suction pump 12 for applying negative pressure to the capping device 11 is arranged under the capping device 11.

The above cap units 37 and 38 not only function as cap means for preventing a nozzle aperture from being dry while the recording apparatus is not used but function as an ink receiver in flushing and means for applying negative pressure from the above suction pump 12 to the recording heads 7 and 8 to suck ink.

Figure 2:
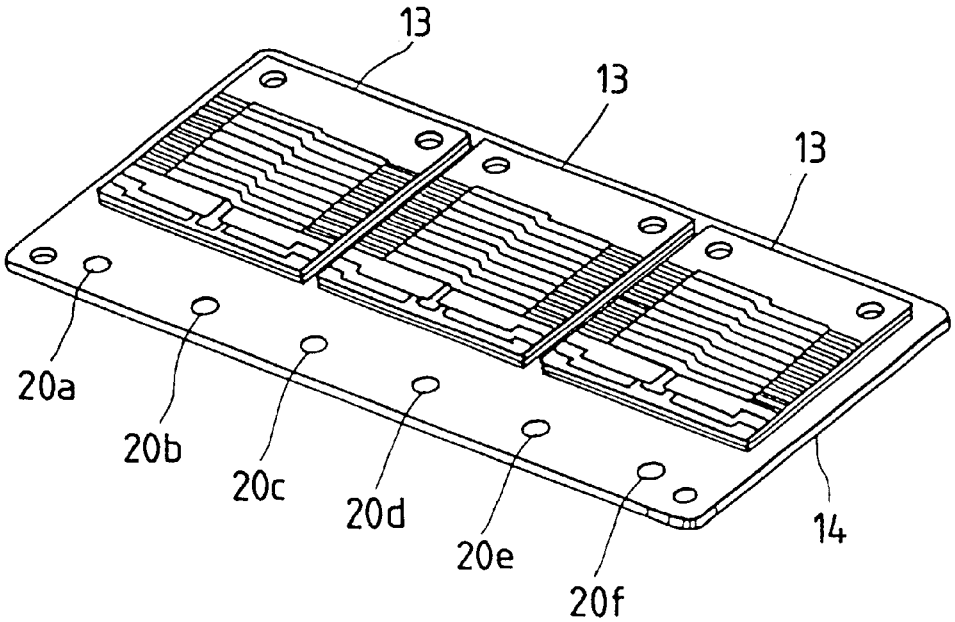
FIG. 2 is a perspective drawing showing an example of an actuator unit in a recording head mounted in the recording apparatus shown in FIG. 1.

FIG. 2 shows an example of an actuator unit in the above recording head for color 8, three piezoelectric vibrators 13 are arranged on a nozzle plate 14 and ink supply passages 20*a* to 20*f* independent every nozzle aperture train are provided between each piezoelectric vibrator 13 and the nozzle plate 14 so that different colors of ink can be jetted from a nozzle aperture train formed on the lower surface not shown in FIG. 2.

Each ink of yellow, cyan and magenta supplied to the ink supply passages 20*a* to 20*f* is jetted from a nozzle aperture train by applying a printing control signal to each piezoelectric vibrator 13 according to the above constitution and color printing is executed on recording paper 6.

Figure 3A:
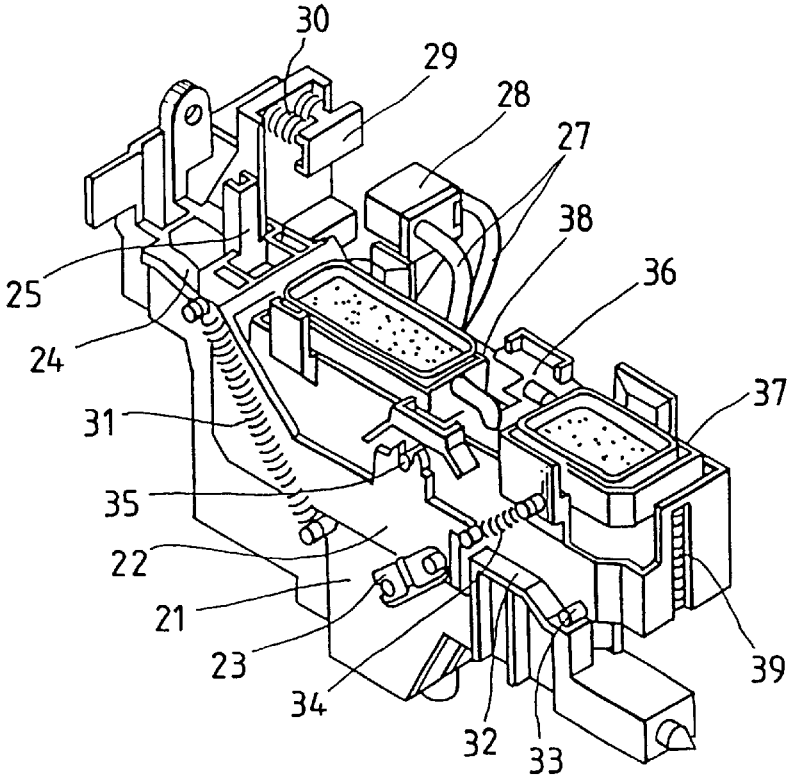
FIGS. 3A and 3B are perspective drawings showing an example of a capping device mounted in the recording apparatus shown in FIG. 1.
Figure 3B:
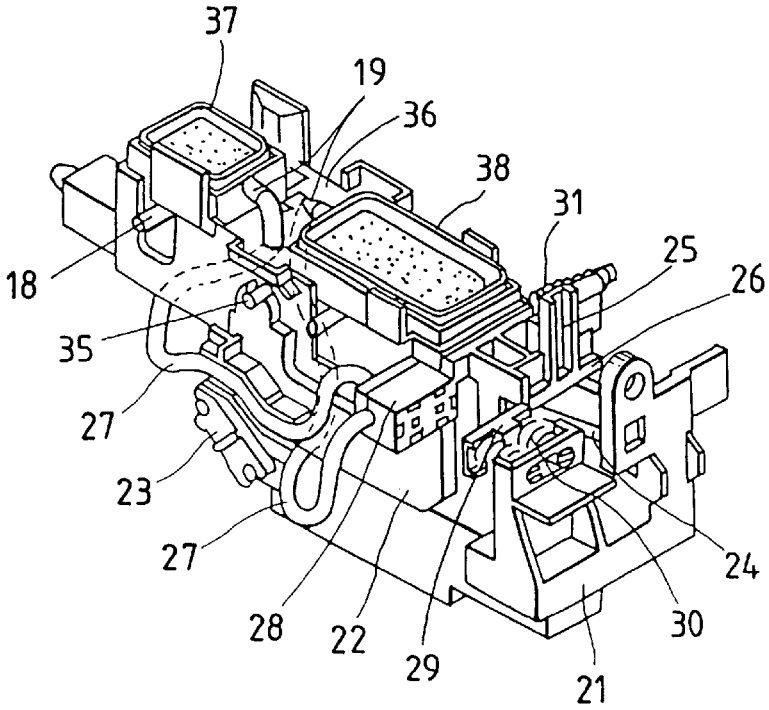

FIGS. 3A and 3B show the whole constitution of the capping device 11, FIG. 3A is a perspective drawing showing the capping device 11 viewed from one direction and FIG. 3B is a perspective drawing showing the capping device viewed from the rear of FIG. 3A.

A reference number 22 is a slider, the slider is coupled to a base 21 by an arm 23 turned freely and a spring 31 and when the carriage 1 is moved to the side of a non-printing area and touched to a flag piece 25, the slider is constituted so that the slider is moved in accordance with the movement of the carriage 1.

A valve unit 28 is fixed to the slider 22 and a valve 29 for opening or closing the valve unit 28 is fixed to the base 21 via a compression spring 30.

The flag piece 25 is provided with a convex piece 26 at the lower end and the convex piece is constituted so that it is touched to a tilted guide face 24 formed on the base 21 and slid on the surface.

A guide face 32 is also provided on the side of a printing area and constituted so that a projection 33 protruded from the slider 22 horizontally is slid on the surface of the guide face.

The slider 22 is constituted so that it can be moved vertically with the slider held approximately horizontal owing to these two guide faces 24 and 32.

That is, the slider is constituted so that capping operation in which a cap member described later and the nozzle plate surface of the recording head are closely touched is executed by moving the slider 22 diagonally upward in accordance with the movement of the carriage 1 when the carriage 1 is moved to the side of a non-printing area.

The part in which the cap unit is mounted 36 of the slider 22 is coupled to the slider 22 by a spring 34 and a projection 35 and can be slightly turned with the projection 35 in the center.

The cap units 37 and 38 are respectively fixed to the slider 22 via a compression spring 39.

Therefore, in capping operation, adhesion between the cap and the nozzle plate is always satisfactorily kept.

An ink suction port 18 is respectively formed at the bottom of the above cap units 37 and 38 as described in detail later and is respectively connected to the suction pump 12 shown in FIG. 1 via a tube not shown which is excellent in resistance to ink.

An atmospheric air open port 19 is respectively arranged in the cap units 37 and 38 as similarly described in detail later and the other end of a tube 27 one end of which is connected to the atmospheric air open port 19 is respectively connected to the valve unit 28 is respectively connected to the valve unit 28.

In the above constitution, when the carriage 1 is moved on the side of a non-printing area, the carriage 1 is touched to the flag piece 25 as described above, hereby, the slider 22 is moved diagonally upward and the cap units 37 and 38 close the nozzle plate surface of the recording head.

When the slider 22 is located on the side of a non-printing area (in a home position), the valve unit 28 is touched to the valve 29 and the atmospheric air open port 19 is closed. When negative pressure is supplied from the suction pump 12 inside the cap in this state, ink can be sucked from a nozzle aperture of the recording head.

An ink jet recording apparatus equivalent to a first embodiment of the present invention will be described below.

Figure 4:
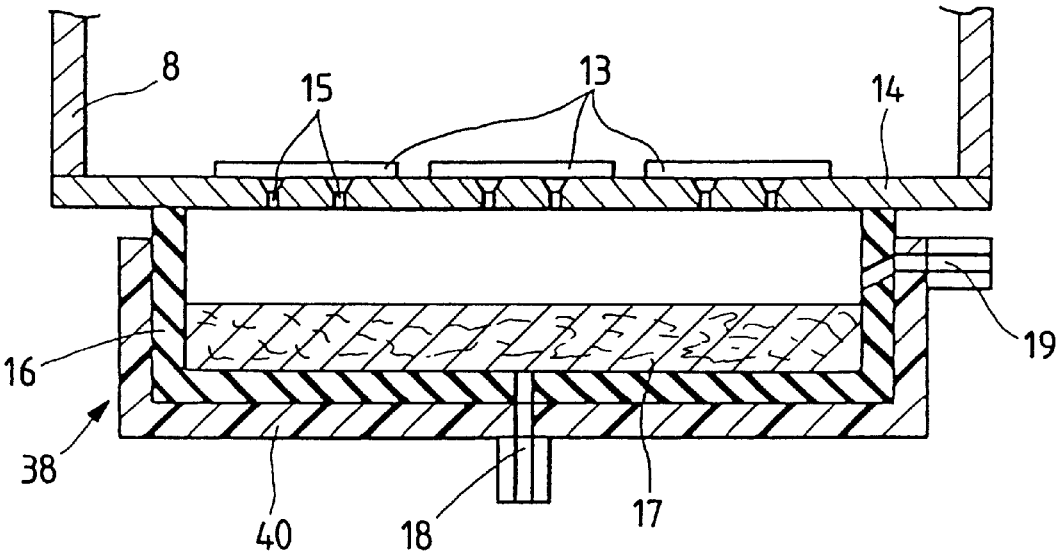
FIG. 4 is a sectional view viewed along a line A—A shown in FIG. 5 showing an example of a cap unit mounted in a recording apparatus equivalent to a first embodiment of the present invention.
Figure 5:
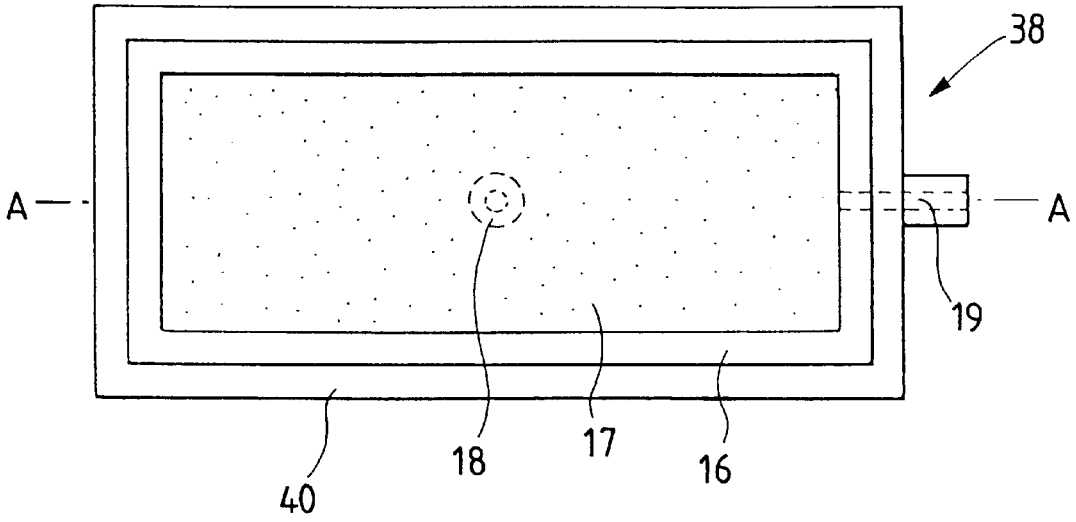
FIG. 5 is a plan showing the cap unit shown in FIG. 4.

FIG. 4 is a sectional view showing a state in which an embodiment of the cap unit for a color head 38 caps in the capping device in the ink jet recording apparatus equivalent to the first embodiment of the present invention and FIG. 5 is a plan similarly showing the cap unit 38.

FIG. 4 is a sectional view viewed along a line A—A shown in FIG. 5.

The cap unit 38 shown in FIGS. 4 and 5 is constituted by a rectangular cap case 40 the top face of which is open and a cap member 16 in the shape of a cup housed in the cap case 40 and formed by an elastic member such as flexible material provided with resistance to ink, particularly rubber.

The cap member 16 is formed so that the upper edge is slightly protruded from the cap case 40.

In an example shown in FIG. 4, an ink absorber 17 formed of porous material which is excellent in resistance to ink and the absorptivity of ink is inserted at the inner bottom of the cap member 16 so that the ink absorber mostly covers the bottom.

The atmospheric air open port 19 for opening the inside of the cap member 16 to the atmospheric air is provided approximately in the center on one side of the cap member 16 with the atmospheric air open port pierced in the direction of the thickness of the cap member 16.

The through hole is formed with it tilted so that it is gradually lowered toward the ink absorber 17 and the opening inside the cap member 16 is formed so that the opening is located above the surface of the ink absorber 17.

The atmospheric air open port 19 is connected to the valve unit 28 via the tube 27 as described above.

As also shown in FIG. 5, the ink suction port 18 is formed at the bottom in approximately the center of the cap member 16 and connected to the suction pump 12 via a tube not shown as described above.

Figure 12:
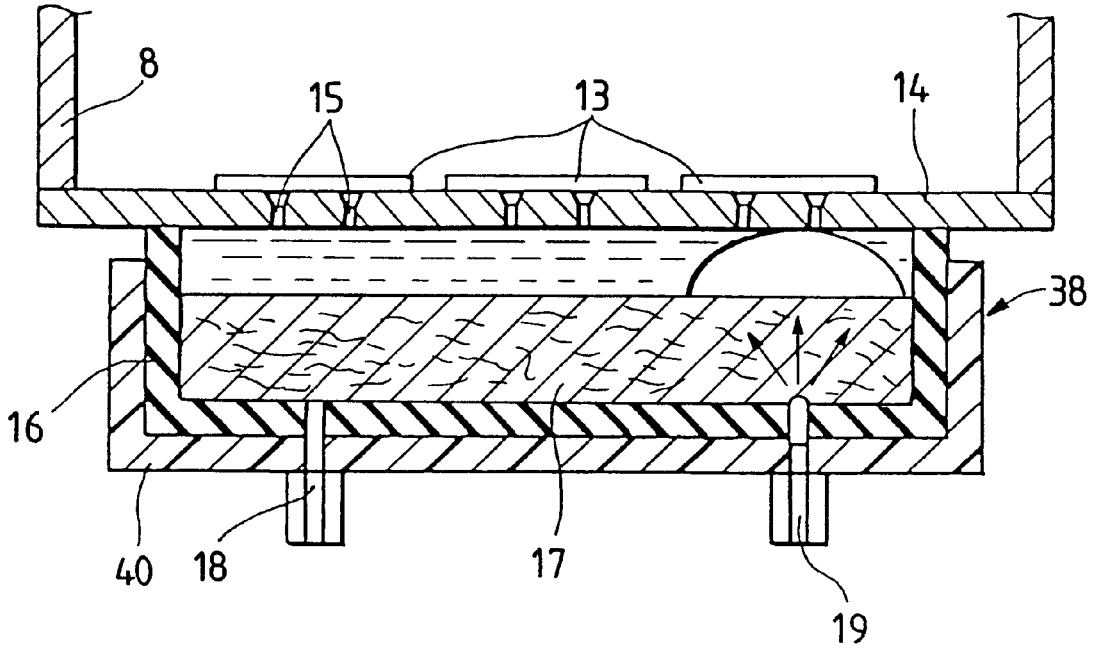
FIG. 12 PRIOR ART
FIG. 12 is a sectional view viewed along a line E—E shown in FIG. 13 showing an example of a cap unit mounted in a conventional type recording apparatus.
Figure 13:
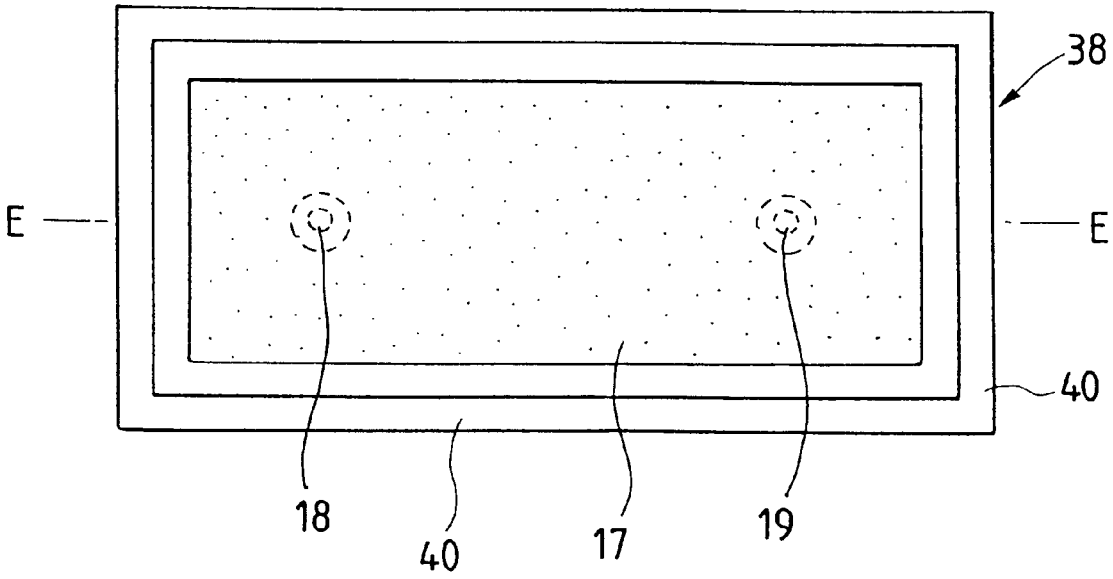
FIG. 13 PRIOR ART
FIG. 13 is a plan showing the cap unit shown in FIG. 12.

The constitution of the recording head 8 shown in FIG. 4 is the same as that already described as the cap unit of the conventional type recording apparatus and shown in FIG. 12 and therefore, the detailed description is omitted.

According to the cap unit 38 constituted as described above, ink sucked from the nozzle aperture 15 of the recording head 8 is exhausted from the ink suction port 18 via the ink absorber 17 inserted at the bottom of the cap.

When a set quantity of ink is exhausted, negative pressure inside the cap is mostly reduced.

As the slider 22 follows the carriage and is moved on the side of a printing area when the carriage 1 is moved on the side of a printing area in this step, the valve unit 28 is released and the atmospheric air flows inside the cap from the atmospheric air open port 19.

As the atmospheric air open port 19 is arranged above 25 the ink absorber 17 on one side of the cap member 16, ink bubbles are never generated in the opening to the atmospheric air.

As the through hole formed in the cap member 16 is tilted toward the ink absorber 17, structure in which ink is hardly left is provided and even if ink is left at the end, ink can be securely prevented from being scattered on the side of the nozzle plate because ink is exhausted toward the ink absorber 17.

Figure 6:
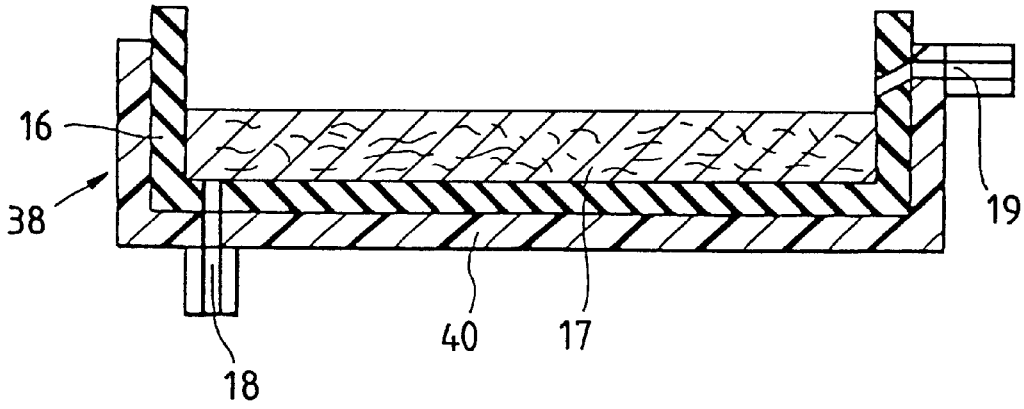
FIG. 6 is a sectional view viewed along a line B—B shown in FIG. 7 showing another example of the cap unit mounted in the recording apparatus equivalent to the first embodiment of the present invention.
Figure 7:
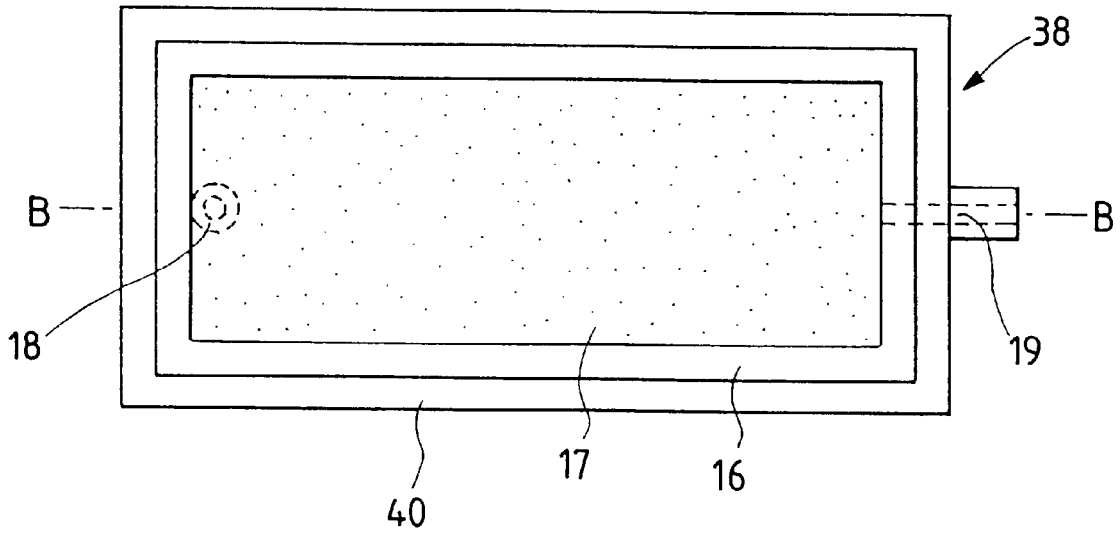
FIG. 7 is a plan showing the cap unit shown in FIG. 6.

Next, FIGS. 6 and 7 are respectively a sectional view and a plan showing another example of the cap unit in the first embodiment.

FIG. 6 is a sectional view viewed along a line B—B shown in FIG. 7.

The same reference number as in FIGS. 4 and 5 denotes the same part as in FIGS. 4 and 5 and therefore, the description is omitted.

In the example shown in FIGS. 6 and 7, particularly, a position in which the ink suction port 18 is arranged is different from the position in the above example shown in FIGS. 4 and 5.

That is, the ink suction port 18 is arranged at the bottom on the other side opposite to one side on which the atmospheric air open port 19 of the cap member 16 is arranged.

Air flows in the longitudinal direction of the cap member 16 in opening to the atmospheric air, that is, along a line B—B shown in FIG. 7 by constituting as described above and ink is satisfactorily drained.

Figure 8:
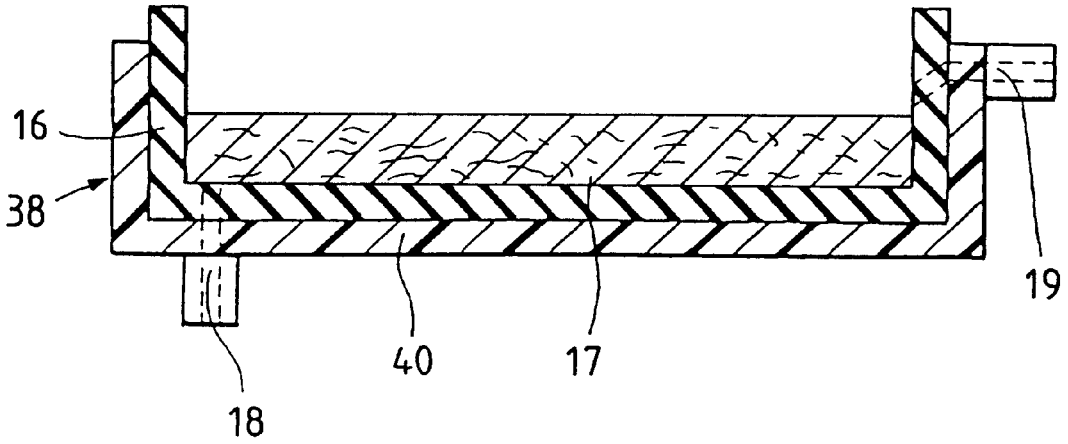
FIG. 8 is a sectional view viewed along a line C—C shown in FIG. 9 showing further another example of the cap unit mounted in the recording apparatus equivalent to the first embodiment of the present invention.
Figure 9:
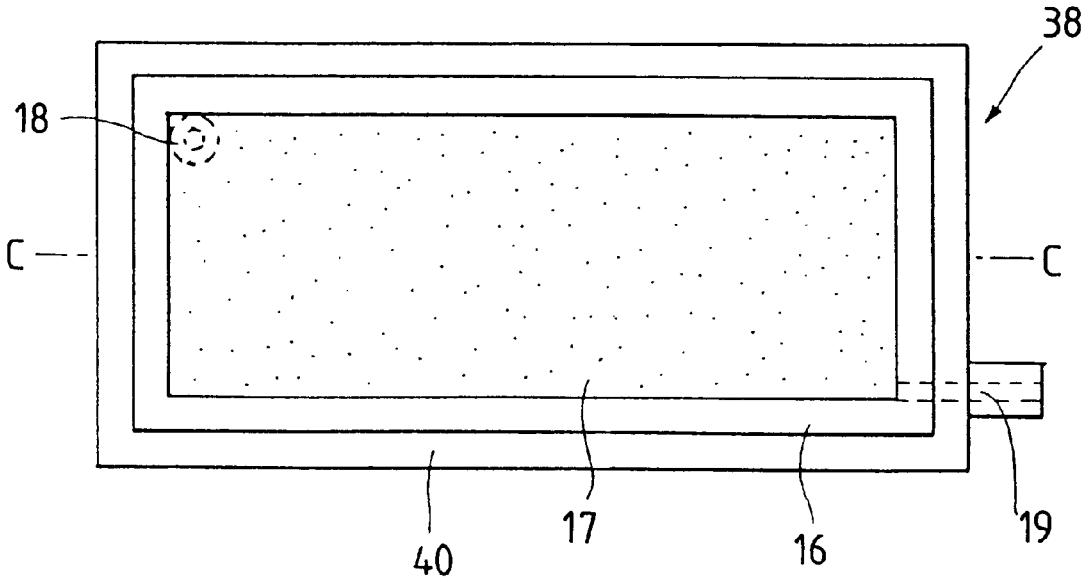
FIG. 9 is a plan showing the cap unit shown in FIG. 8.

Next, FIGS. 8 and 9 are a sectional view and a plan respectively showing further another example of the cap unit.

FIG. 8 is a sectional view viewed along a line C—C shown in FIG. 9.

The same reference number as in FIGS. 4 and 5 denotes the same part as in FIGS. 4 and 5 and therefore, the description is omitted.

In the example shown in FIGS. 8 and 9, particularly, positions in which the atmospheric air open port 19 and the ink suction port 18 are arranged are different from those in the second example shown in FIGS. 6 and 7.

That is, the atmospheric air open port 19 is arranged at a corner on one side of the rectangular cap member 16 and the ink suction port 18 is arranged at the bottom at a corner opposite to the atmospheric air open port 19 diagonally.

Air flows along the diagonal direction of the cap member 16 in opening to the atmospheric air by constituting as described above and ink is further satisfactorily drained, compared with the second example.

Figure 10:
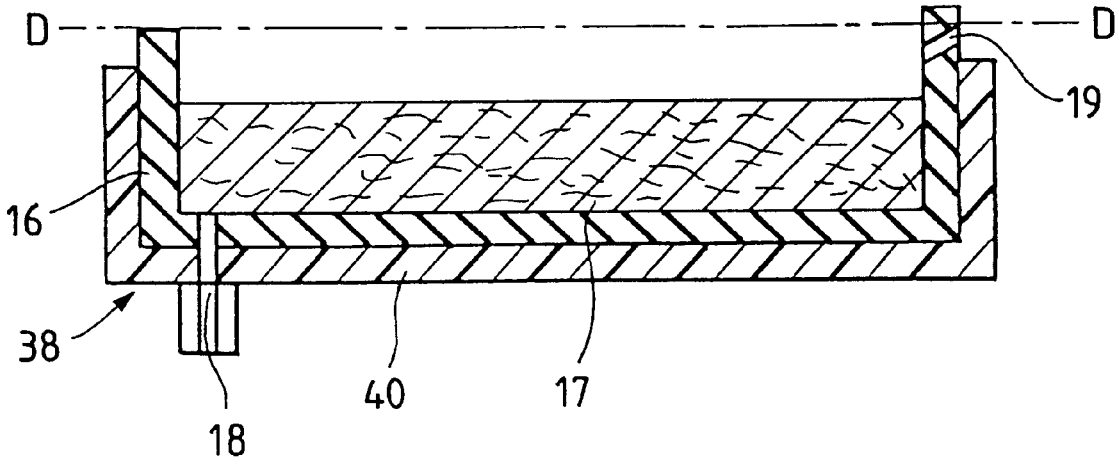
FIG. 10 is a central sectional view showing further another example of the cap unit mounted in the recording apparatus equivalent to the first embodiment of the present invention.
Figure 11:
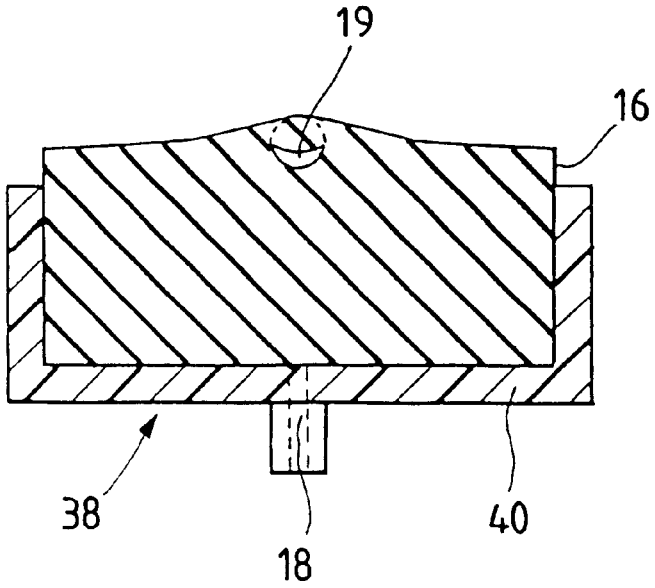
FIG. 11 is a side view showing a state in which a part is perspective of the cap unit shown in FIG. 10.

Next, in an example shown in FIGS. 10 and 11, particularly, the cap member 16 itself is provided with a valve function with the other characteristics of the cap member in the above example kept unchanged.

The same reference number as in FIGS. 4 and 5 denotes the same part as in FIGS. 4 and 5 and therefore, the description is omitted.

In the example shown in FIGS. 10 and 11, the atmospheric air open port 19 pierced in the direction of the thickness of the cap member 16 is provided approximately in the center of one side of the cap member 16 protruded from the cap case 40.

The atmospheric air open port 19 is formed in a crescent shape as shown in FIG. 11 and arranged so that the longer side is directed horizontally and the shorter side is directed vertically.

The atmospheric air open port 19 which pierces the cap member 16 is formed so that a through hole constituting the atmospheric air open port 19 is gradually tilted toward the ink absorber 17 as in the above first to third examples and formed so that the opening on the inner side of the cap member 16 is formed so that the opening is located over the surface of the ink absorber 17. As shown by a horizontal line D in FIG. 10, the upper edge of the cap member 16 at which the atmospheric air open port 19 is provided protrudes above the other upper edge.

The position of the ink suction port 18 is arranged in the same position as in the example shown in FIGS. 6 and 7.

The atmospheric air open port 19 is closed when the capping device is pressed upon the recording head nozzle surface, as described above so that the cap can be kept airtight.

The closed state of the atmospheric air open port 19 is restored by reducing pressure and opening the cap to the atmospheric air.

The atmospheric air open port 19 also functions as a valve so that the atmospheric air open port 19 is closed or opened according to the pressure of the cap member 16 upon the recording head as described above and the valve unit 28 shown in FIG. 3, the valve 29 for opening or closing the valve unit 28 and others are not required.

The valve can be securely opened or closed by the atmospheric air open port 19 and the reliability of operation can be enhanced by particularly forming the atmospheric air open port 19 in a crescent shape and forming the atmospheric air open port so that the upper edge on which the atmospheric air open port 19 is provided on the cap member 16 is protruded from the other edge, as shown in FIG. 10.

In the above embodiment, the ink jet recording apparatus in which the recording head utilizing the piezoelectric vibrator as an actuator is mounted is described as the example, however, it is clear that the same action is also produced in an ink jet recording apparatus in which a so-called bubble jet recording head for vaporizing ink using a heater and jetting ink by the pressure of bubbles is mounted.

As the above ink jet recording apparatus equivalent to the first embodiment of the present invention is provided with the atmospheric air open port for opening the inside of the cap to the atmospheric air on one side of the cap member, ink bubbles can be securely prevented from being generated, ink can be securely prevented from being scattered on the side of the nozzle plate in opening to the atmospheric air and hereby, color mixture, mottled color, the failure of printing in a dot and others can be prevented.

As the ink suction port is arranged at the bottom on the other side opposite to one side on which the atmospheric air open port is arranged or the ink suction port is arranged at the bottom at a corner opposite to the atmospheric air open port diagonally, air can flow toward the ink suction port in the cap in opening to the atmospheric air and ink can be satisfactorily drained.

Further, as the atmospheric air open port is formed so that it pierces the cap member in the direction of the thickness, the atmospheric air open port can also function as a valve for opening or closing the atmospheric air open port according to the pressure of the cap member upon the recording head and the constitution of the apparatus can be also simplified.

Next, an ink jet recording apparatus equivalent to a second embodiment of the present invention will be described.

Figure 14A:
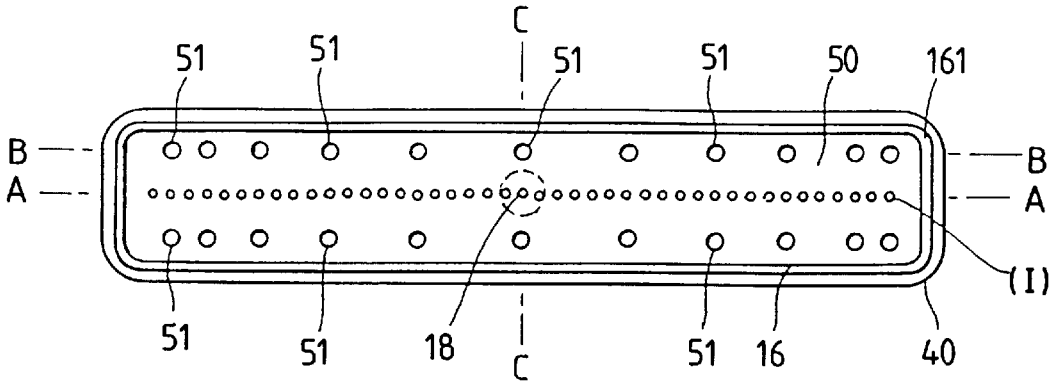
FIGS. 14A to 14D show an example of a cap unit mounted a recording apparatus equivalent to a second embodiment of the present invention.
Figure 14B:
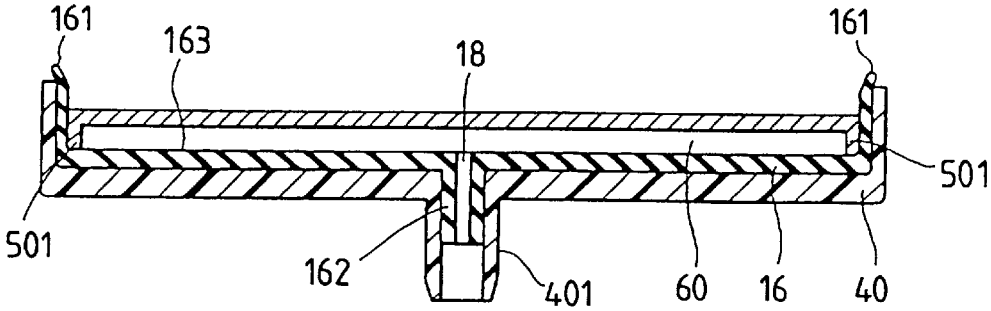
Figure 14C:
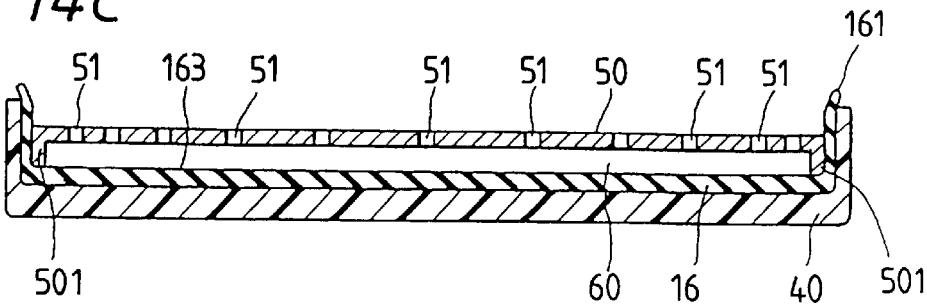
Figure 14D:
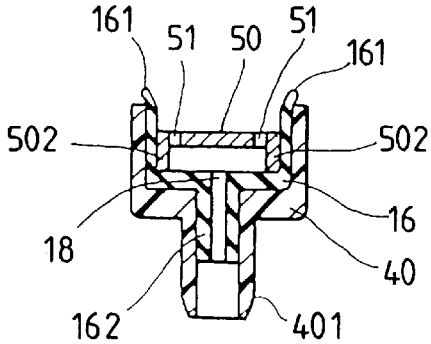

FIGS. 14A to 14D show an example of a cap unit of a capping device in the ink jet recording apparatus equivalent to the second embodiment of the present invention, FIG. 14A is a plan, FIG. 14B is a sectional view viewed along a line A—A, FIG. 14C is a sectional view viewed along a line B—B and FIG. 14D is a sectional view viewed along a line C—C.

In the cap unit, a laminated cap member 16 formed by the injection molding of butyl rubber provided with resistance to ink and elasticity and others is inserted into a cap case 40 which is a member for attaching to a base and an ink suction port 18 communicating with an external suction pump is provided approximately in the center of the bottom 163.

A wall 161 for adhering to the nozzle plate of a recording head is formed on the upper surface of the cap member 16, a tube for connection 162 is integrated with the outer surface of the ink suction port 18, the tube 162 is housed in a connecting tube 401 formed at the bottom of the cap case 40. The connecting tube 401 is connected to a tube for connecting the cap case 40 to the suction pump.

A reference number 50 denotes a porous plate by which the present invention is characterized and the porous plate is housed in parallel with the bottom 163 of the cap in the cap member 16 so that the periphery of the porous plate is elastically touched to the inner periphery of the cap member 16 airtightly.

Through holes 51 with the same inside diameter are made in the porous plate 50 so that density is increased as distance from the ink supply port 18 is increased and supporting portions 501 and 502 which are in contact with the bottom 163 of the cap member 16 are formed at the end on the side of the lower surface.

The porous plate 50 is coated by water repellent material such as polytetrafluoroethylene, polyfluorovinylidene and polyfluorovinyl or the like, or is coated by eutectoid plating, or the porous plate itself is formed by water repellent material so that at least the surface opposite to the nozzle plate is provided with a property which repels ink.

In this embodiment, when the cap member 16 is elastically touched to the nozzle plate of the recording head to cap the nozzle plate and the suction pump not shown is operated, negative pressure is applied to space 60 between the bottom 163 of the cap member 16 and the porous plate 50 and is also applied to the nozzle plate via the through holes 51 of the porous plate 50.

As the density of the through holes 51 is increased as distance from the ink suction port 18 is increased, fixed negative pressure is applied to a nozzle aperture (I) independent of distance from the ink suction port 18 and ink is exhausted at as a uniform flow rate as possible from all nozzle apertures (I).

Ink exhausted into the porous plate 50 is exhausted outside from the ink suction port 18 via the through holes 51 without mostly wetting the porous plate because of the ink repellent property of the surface of the porous plate 50.

Figure 15:
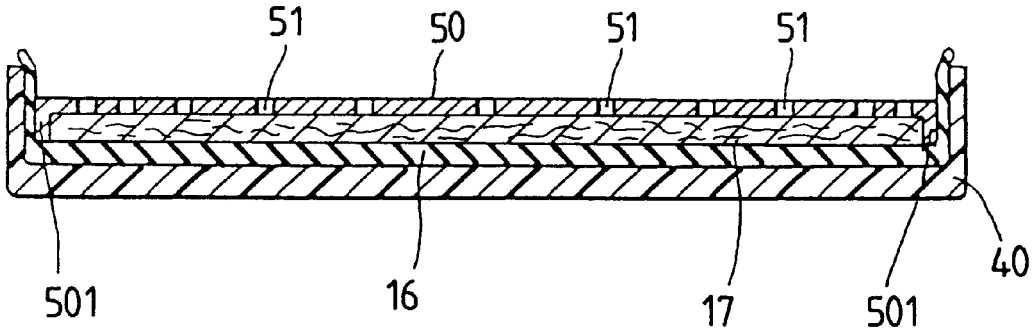
FIG. 15 is a sectional view showing another example of the cap unit mounted in the recording apparatus equivalent to the second embodiment of the present invention.

In the above embodiment, space is constituted under the lower surface of the porous plate 50, however, as shown in FIG. 15, even if an ink absorber sheet 17 formed of porous material provided with the absorptivity of ink and permeability is inserted, the similar effect is produced.

Figure 16A:
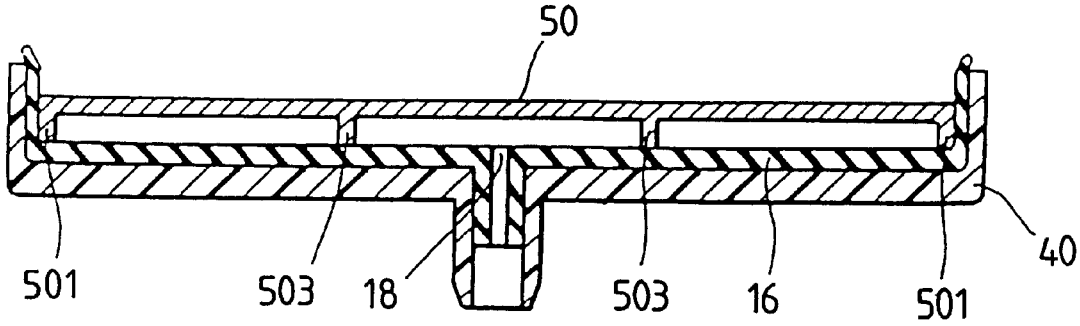
FIGS. 16A to 16C are sectional views respectively showing examples in which a porous plate is supported in the cap unit mounted in the recording apparatus equivalent to the second embodiment of the present invention.
Figure 16B:
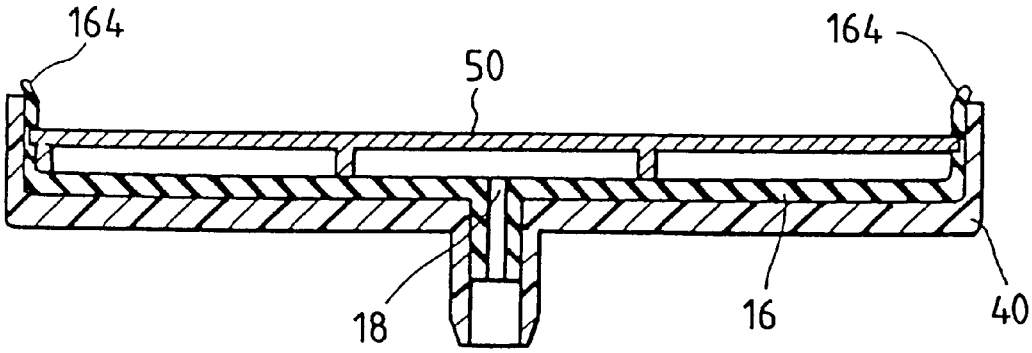
Figure 16C:
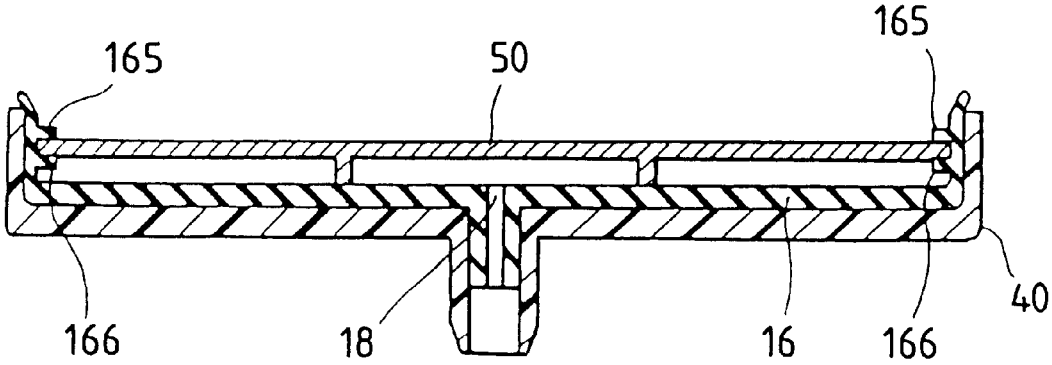

In the above embodiment, the porous plate 50 is supported only at the end, however, a warp and others can be prevented by also forming supporting portions 503 in the center of the rear surface as shown in FIG. 16A, as shown in FIG. 16B, a groove 164 is formed on the inner surface of the cap member 16, the edge of the porous plate is fitted into the groove and supported and further, as shown in FIG. 16C, projections 165 are formed on the inner surface of the cap member 16 and the porous plate may be also supported by the projections.

Figure 17:
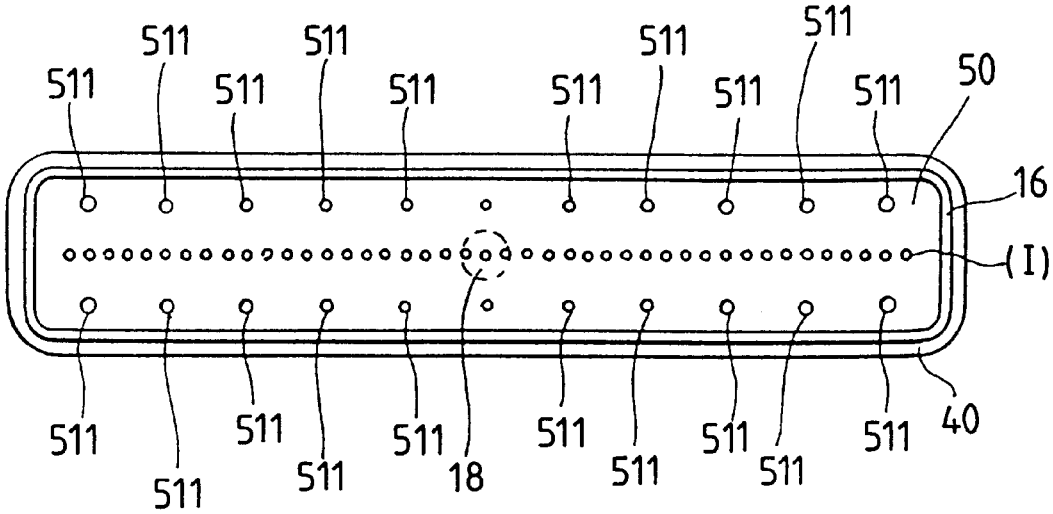
FIG. 17 is a plan showing further another example of the cap unit mounted in the recording apparatus equivalent to the second embodiment of the present invention.

Further, in the above embodiment, the resistance of a passage is adjusted by the density of the through hole 51, however, as shown in FIG. 17, the through holes may be also formed at an equal interval, while through holes 511 the inside diameter of each of which is increased as distance from the ink suction port 18 is increased may be also formed.

Figure 18:
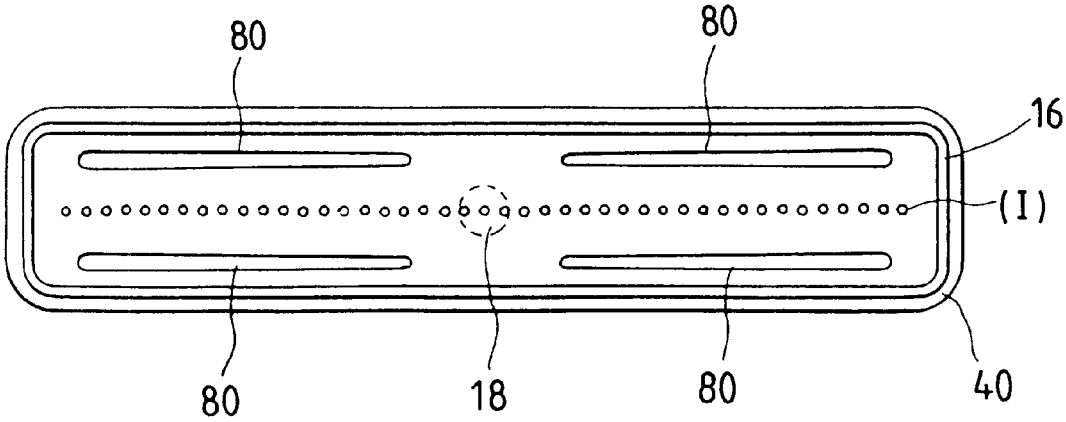
FIG. 18 is a plan showing further another example of the cap unit mounted in the recording apparatus equivalent to the second embodiment of the present invention.

Further, in the above embodiment, the upper surface and the lower surface communicate via the through holes, however, as shown in FIG. 18, it is clear that even if long holes 80 extended in parallel with a direction in which nozzle apertures (I) are arranged are formed in the porous plate 50 in a direction from the ink supply port 18 to the end, the similar action is produced.

Desirably, when the width of the long hole 80 is increased as distance from the ink suction port 18 is increased, pressure applied to a nozzle aperture (I) can be fixed as much as possible independent of the position of the nozzle aperture (I).

However, if the cap is large-sized, it is very difficult to exhaust ink in a position far from the ink supply port 18 outside.

Figure 19A:
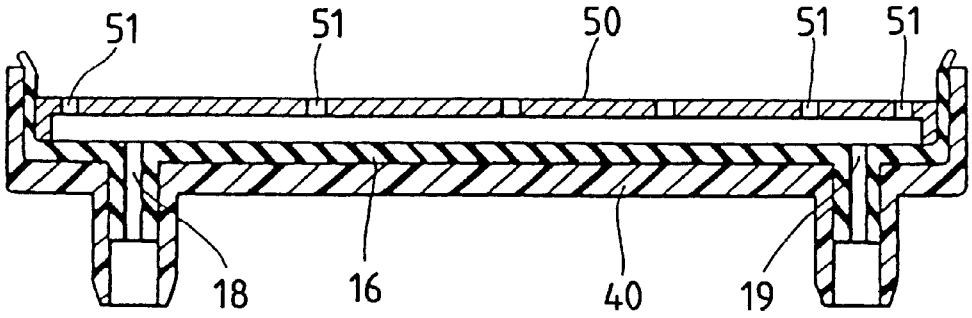
FIGS. 19A to 19C are respectively a sectional view, a plan and a sectional view showing further another example of the cap unit mounted in the recording apparatus equivalent to the second embodiment of the present invention.
Figure 19B:
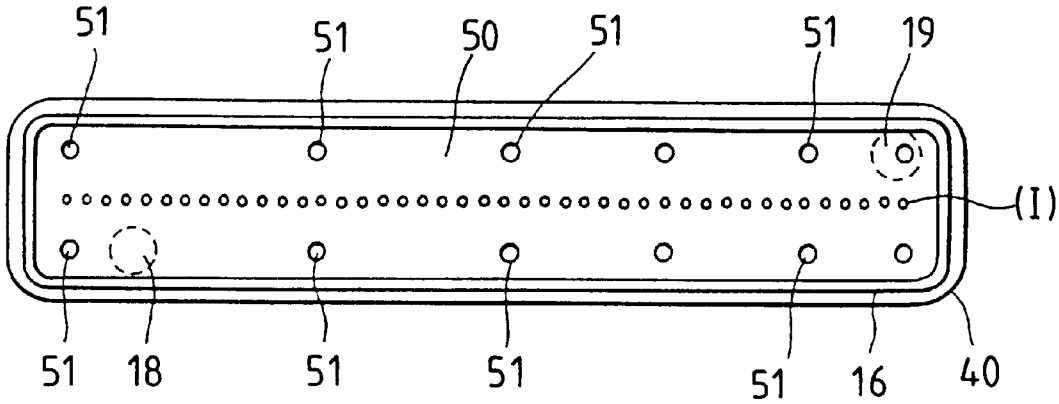

FIGS. 19A and 19B show a clue for solving such a problem and the atmospheric air open port 19 selectively communicating with the atmosphere via a valve not shown outside the cap is formed in a position far from the ink suction port 18.

According to this embodiment, if ink is exhausted from the recording head, the atmospheric air open port 19 is closed and negative pressure is applied to the recording head.

When the exhaustion of ink is finished, the atmospheric air open port 19 is opened, when negative pressure from the suction pump is again applied, an air current from the atmospheric air open port 19 to the ink suction port 18 in the cap member 16 is generated without applying such negative pressure as exhausts ink into the recording head, ink is moved to the ink suction port 18 and can be exhausted more securely.

It is desirable that the ink suction port 18 and the atmospheric air open port 19 are arranged diagonally in the longitudinal direction as shown in FIG. 19B.

Figure 19C:
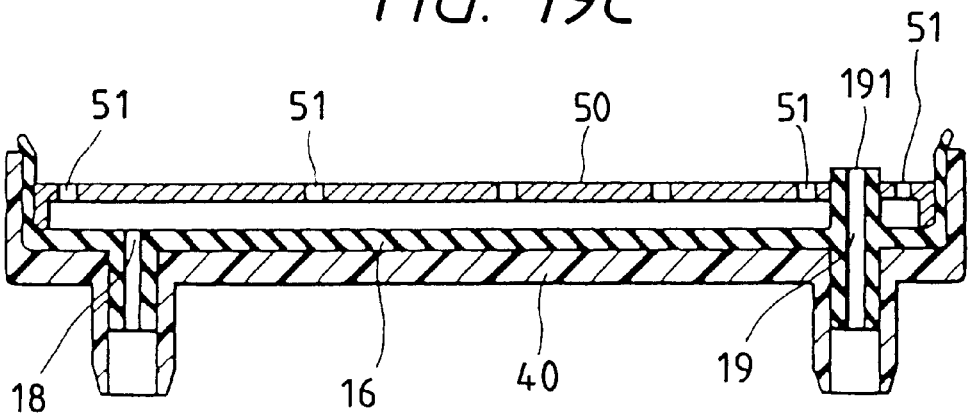

As shown in FIG. 19C, the end 191 of the atmospheric air open port 19 pierces the porous plate 50 and may be directly opposite to the nozzle plate.

As in the above ink jet recording apparatus equivalent to the second embodiment of the present invention, the porous plate provided with plural through holes for adjusting the distribution of pressure in the longitudinal direction is arranged between the bottom of the cap and the open face of the cap, negative pressure from a few ink suction ports can be adjusted so that the above negative pressure is uniformly applied to all nozzle apertures and ink can be uniformly exhausted from all the nozzle apertures.

Therefore, ink can be satisfactorily drained and clear images and printing free from color mixture, mottled color and the failure of printing in a dot can be provided.

Next, finally, an ink suction method of the recording head of the ink jet recording apparatus according to the present invention will be described.

Figure 20A:
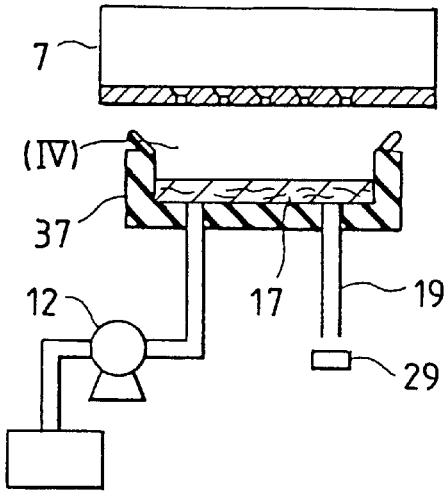
FIGS. 20A to 20D are explanatory drawings respectively showing an embodiment of an ink suction method according to the present invention.

In the ink jet recording apparatus according to the present invention shown in FIGS. 1, 3A and 3B, the recording head 7 (8) is moved to a home position and is opposed to the cap unit 37 (38) as shown in FIG. 20A, a driving signal not related to a printing signal is applied to the recording head and flushing is executed.

Figure 20B:
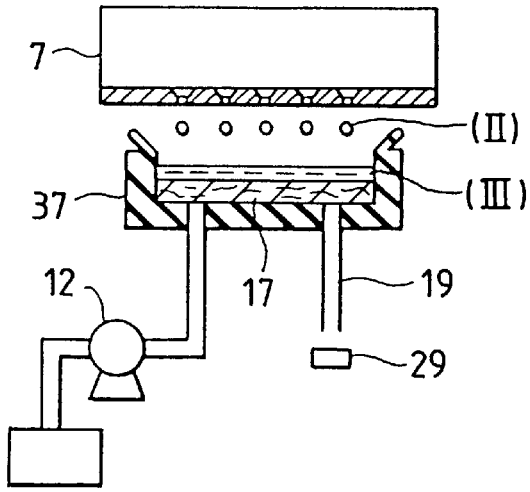

An ink droplet (II) jetted from the recording head 7 (8) is absorbed in the ink absorber sheet 17 of the cap unit 37 (38) and when the absorption is saturated, the level of ink rises as shown in FIG. 20B.

When ink to some extent is collected in the cap unit 37 (38), the carriage 1 is moved in a position in which it can be sealed, the cap unit 37 (38) is lifted and the recording head 7 (8) is sealed with the cap unit 37 (38).

Figure 20C:
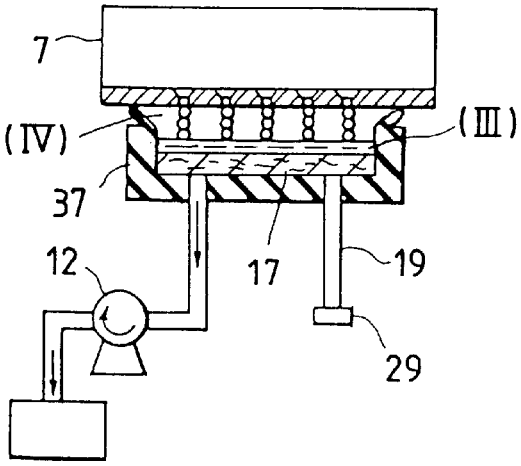

When the pump 12 is operated in this state, ink is exhausted from the recording head 7 (8) into space (IV). the volume of which is reduced by ink (III) as shown in FIG. 20C.

Hereby, as the quantity of air included in ink is smaller, compared with a case that ink is exhausted into a cap unit with the large volume (IV) of space not filled with ink beforehand and direct contact between ink and the ink absorber sheet 17 is prevented, bubbling is inhibited.

Figure 20D:
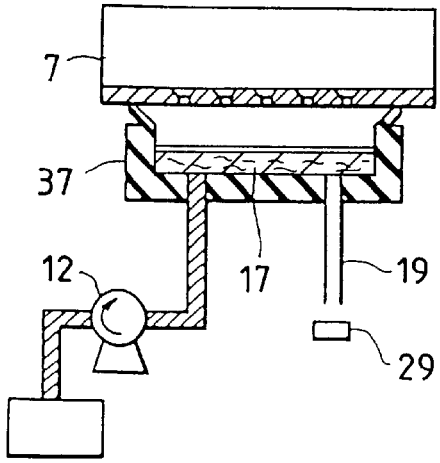

When the exhaust of ink from the recording head 7 is finished, the pump 12 is driven at low speed and ink left in the cap unit 37 (38) is exhausted without applying useless negative pressure to the recording head 7 (8) as shown in FIG. 20D after the carriage 1 is slightly moved to some extent that the sealing of the recording head 7 (8) by the cap 37 (38) can be maintained and the atmospheric air open port 19 can be opened.

Figure 21A:
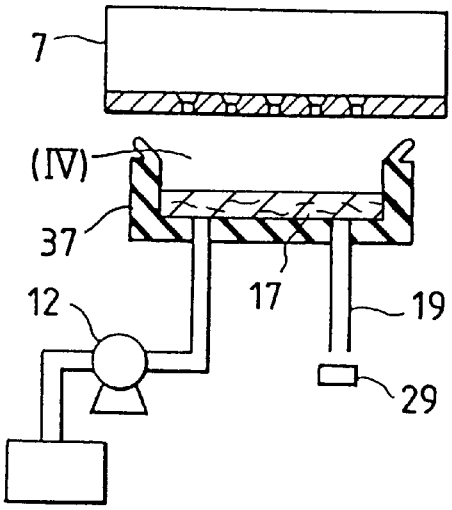
FIGS. 21A to 21D are explanatory drawings respectively showing another embodiment of the ink suction method according to the present invention.
Figure 21B:
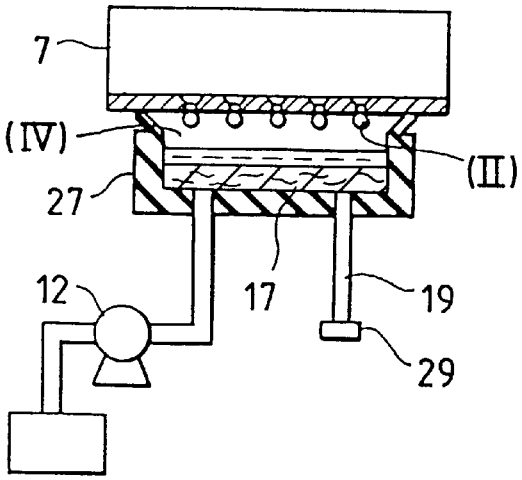

In the above embodiment, ink is filled in the cap unit 37 (38) by flushing as shown in FIG. 20B, however, instead, the following may be also executed:

That is, the carriage 1 is moved to a position immediately before the cap 37 (38) seals the recording head 7 (8) and to a position in which the atmospheric air open port 19 is sealed further from a flushing position shown in FIG. 21A Then, the pump unit 12 is driven at low speed in this state and slight quantity of ink (II) is jetted from the recording head 7 (8) as shown in FIG. 21B.

Hereby, an ink droplet (II) jetted from the recording head 7 (8) is absorbed in the ink absorber sheet 17 of the cap unit 37 (38). When absorption is saturated and the level of ink rises to a predetermined position, the carriage 1 is moved to a sealing position, the cap unit is lifted and the recording head 7 (8) is sealed by the cap unit 37 (38).

Figure 21C:
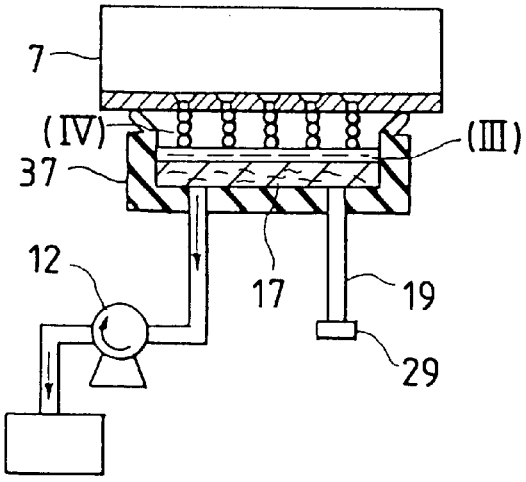

When the pump unit 12 is operated at high speed in this state, ink is exhausted from the recording head 7 (8) into the space (IV) the volume of which is reduced by the ink (III), the quantity of air included in the ink is decreased and the ink is exhausted without bubbling as shown in FIG. 21C.

Figure 21D:
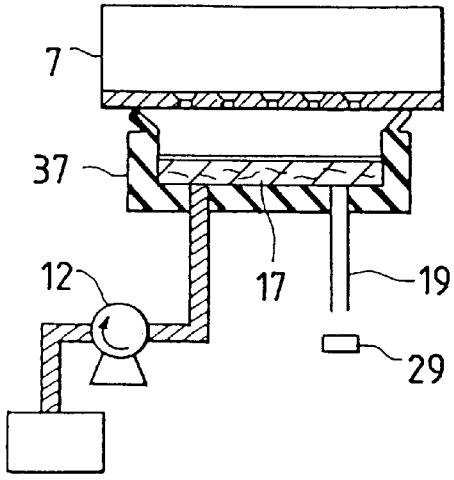

When the exhaust of ink from the recording head 7 (8) is finished, the pump 12 is again driven at low speed and ink left in the cap unit is exhausted without applying useless negative pressure to the recording head as shown in FIG. 21D after the carriage 1 is slightly moved to some extent that the sealing of the recording head 7 by the cap unit 37 (38) can be maintained and the atmospheric air open port 19 can be opened.

Fine holes in the ink absorber sheet housed in the cap unit of the capping device can be sealed with ink beforehand, the volume of space in the cap can be decreased, the inclusion of air can be inhibited and bubbles can be prevented from being generated in sucking ink by applying the ink suction method of the ink jet recording head according to the present invention.

What is claimed is:

1. An ink jet recording apparatus comprising:

a nozzle ink jet recording head including a nozzle plate having apertures for jetting an ink droplet; and a capping device having a rectangular cap unit for sealing said apertures of said nozzle plate when said recording apparatus is not used, wherein said cap unit of said capping device comprises:

an ink suction port being arranged at a bottom of said cap unit for supplying negative pressure so as to exhaust ink from said apertures in a sealed state of said apertures; and a porous plate being housed between an inner bottom face and an upper open face of said cap unit, said porous plate having plural through holes for adjusting a distribution of pressure in a longitudinal direction of said cap unit, wherein a periphery of said porous plate contacts an inner periphery of said cap unit.

2. The ink jet recording apparatus according to claim 1, wherein a density in which said through holes are arranged of said porous plate is increased as distance from said ink suction port is increased.

3. The inkjet recording apparatus according to claim 1, wherein inner diameters of said through holes are increased as distance from said ink suction port is increased.

4. The ink jet recording apparatus according to claim 1, wherein said plural through holes are formed in a form of a long hole extended from a vicinity of said ink suction port to an end of said cap.

5. The ink jet recording apparatus according to claim 4, wherein a width of said long hole is increased as distance from said ink suction port is increased.

6. The ink jet recording apparatus according to claim 1, wherein at least a surface opposite to said nozzle plate of said porous plate is provided with an ink repellent property.

7. The ink jet recording apparatus according to claim 1, wherein said porous plate has supporting portions touched to an inner surface of said cap unit.

8. The ink jet recording apparatus according to claim 1, wherein an edge of said porous plate is fixed by a fixing portion formed on an inner surface of said cap unit.

9. The ink jet recording apparatus according to claim 1, further comprising a porous sheet inserted between said porous plate and the bottom of said cap unit.

10. The ink jet recording apparatus according to claim 1, wherein said cap unit further includes an atmospheric air open port selectively communicating with an atmospheric air at a fixed interval with said ink suction port.

11. The ink jet recording apparatus according to claim 10, wherein said ink suction port and said atmospheric air open port are arranged so that they are located diagonally in a longitudinal direction of said cap member.

12. The ink jet recording apparatus according to claim 10, wherein said atmospheric air open port is extended to a position so as to extend through said porous plate.

13. The ink jet recording apparatus according to claim 1, wherein said cap unit comprises a cap case and a laminated cap member formed of flexible material arranged inside said cap case, and said cap member is formed so as to be protruded from an upper edge of said cap case.

14. The ink jet recording apparatus according to claim 1, wherein the through holes in said porous plate have the same diameter.

15. The ink jet recording apparatus according to claim 1, wherein the through holes form two parallel lines so as not to overlap with the apertures of said nozzle plate.

16. A cap unit for sealing apertures for jetting an ink droplet when an inkjet recording apparatus is not used, the apertures being provided in a nozzle plate of a recording head of the ink jet recording apparatus, comprising:

an ink suction port being arranged at a bottom of said cap unit and supplying negative pressure so as to exhaust ink from said apertures in a sealed state of said apertures; and a porous plate being housed between an inner bottom face and an upper open face of said cap unit, said porous plate having plural through holes for adjusting a distribution of pressure in a longitudinal direction of said cap unit, wherein a periphery of said porous plate contacts an inner periphery of said cap unit.

17. The cap unit according to claim 16, wherein a density in which said through holes are arranged of said porous plate is increased as distance from said ink suction port is increased.

18. The cap unit according to claim 16, wherein inner diameters of said through holes are increased as distance from said ink suction port is increased.

19. The cap unit according to claim 16, wherein said plural through holes are formed in a form of a long hole extended from a vicinity of said ink suction port to an end of said cap.

20. The cap unit according to claim 19, wherein a width of said long hole is increased as distance from said ink suction port is increased.

21. The cap unit according to claim 16, wherein at least a surface opposite to said nozzle plate of said porous plate is provided with an ink repellent property.

22. The cap unit according to claim 16, wherein said porous plate has supporting portions touched to an inner surface of said cap unit.

23. The cap unit according to claim 16, wherein an edge of said porous plate is fixed by a fixing portion formed on an inner surface of said cap unit.

24. The cap unit according to claim 16, further comprising a porous sheet inserted between said porous plate and the bottom of said cap unit.

25. The cap unit according to claim 16, wherein said cap unit further includes an atmospheric air open port selectively communicating with an atmospheric air at a fixed interval with said ink suction port.

26. The cap unit according to claim 25, wherein said ink suction port and said atmospheric air open port are arranged so that they are located diagonally in a longitudinal direction of said cap member.

27. The cap unit according to claim 25, wherein said atmospheric air open port is extended to a position so as to extend through said porous plate.

28. The cap unit according to claim 16, wherein said cap unit comprises a cap case and a laminated cap member formed of flexible material arranged inside said cap case, and said cap member is formed so as to be protruded from an upper edge of said cap case.

29. The cap unit according to claim 16, wherein the through holes in said porous plate have the same diameter.

30. The cap unit according to claim 16, wherein the through holes form two parallel lines so as not to overlap with the apertures of said nozzle plate.

* * * * *